US005707454A

United States Patent [19]

Middleton

[11] Patent Number: 5,707,454

[45] Date of Patent: Jan. 13, 1998

[54] METHOD FOR REMOVING SPOTS FROM CARPET

[75] Inventor: Ernest W. Middleton, Racine, Wis.

[73] Assignee: Racine Industries, Inc., Racine, Wis.

[21] Appl. No.: 584,292

[22] Filed: Jan. 11, 1996

Related U.S. Application Data

[62] Division of Ser. No. 338,948, Nov. 14, 1994, Pat. No. 5,537,707.

[51] Int. Cl.[6] ..... B08B 1/00; A46B 9/02; A46B 15/00

[52] U.S. Cl. ..... 134/6; 134/42; 15/106; 15/160; 15/172; 15/176.2; 15/204.2; 15/DIG. 5

[58] Field of Search ..... 134/6, 42; 15/106, 15/160, 172, 176.2, 207.2, DIG. 5

[56] References Cited

U.S. PATENT DOCUMENTS

| | | | |
|---|---|---|---|
| 8,714 | 2/1852 | Adams | 15/106 |
| 1,487,075 | 3/1924 | Olson et al. | 15/106 |
| 2,043,758 | 6/1936 | Lay | 15/159.1 |
| 2,250,112 | 7/1941 | Larson | 15/160 |
| 2,312,108 | 2/1943 | Mead | 401/137 |
| 2,705,336 | 4/1955 | Wilson | 15/144.1 |
| 3,229,318 | 1/1966 | Clemens | 15/207.2 |
| 3,346,900 | 10/1967 | Stewart et al. | 15/160 |
| 4,255,827 | 3/1981 | Palazzo | 15/DIG. 5 |
| 4,360,940 | 11/1982 | Smith | 15/160 |
| 4,422,202 | 12/1983 | Malvasio | 15/106 |
| 4,610,045 | 9/1986 | Rauch | 15/DIG. 6 |
| 4,831,678 | 5/1989 | Dietsche | 15/176.4 |
| 4,853,041 | 8/1989 | Clardy | 15/160 |

FOREIGN PATENT DOCUMENTS

| | | | |
|---|---|---|---|
| 503854 | 10/1952 | Belgium | 15/106 |
| 523276 | 8/1921 | France | 15/176.4 |
| 1038925 | 5/1953 | France | 15/106 |
| 1051636 | 9/1953 | France | 15/160 |
| 867237 | 2/1953 | Germany | 15/106 |
| 3640000 | 5/1988 | Germany | 15/159.1 |
| 301396 | 11/1954 | Switzerland | 15/160 |
| 2859 | of 1861 | United Kingdom | 15/106 |
| 5293 | of 1891 | United Kingdom | 15/DIG. 6 |
| 19956 | of 1914 | United Kingdom | 15/176.3 |
| 438333 | 11/1935 | United Kingdom | 15/106 |

*Primary Examiner*—Zeinab El-Arini
*Attorney, Agent, or Firm*—Jansson & Shupe, Ltd.

[57] ABSTRACT

The method substantially removes a soil spot (resulting from a beverage spill or the like) from a carpet by using a particular type of brush. The brush has (a) a detachable handle, (b) a body with a pair of holes therein for attaching the handle to the body at either hole, and (c) first and second brush portions on first and second brush faces, respectively. The brush portions have differing stiffnesses and either portion may be used to "de-spot" carpet by inserting the handle in the appropriate attachment hole. The method includes the steps of identifying the tuft and pile characteristics of the spot-soiled area of carpet and selecting one of the brush portions for use in removing the spot on carpet having such characteristics. The handle is attached to the hole related to the selected brush portion, a granular cleaning product is deposited on the spot and such product is "worked" across and through that portion of the carpet which includes the spot.

3 Claims, 6 Drawing Sheets

FIG. 3A
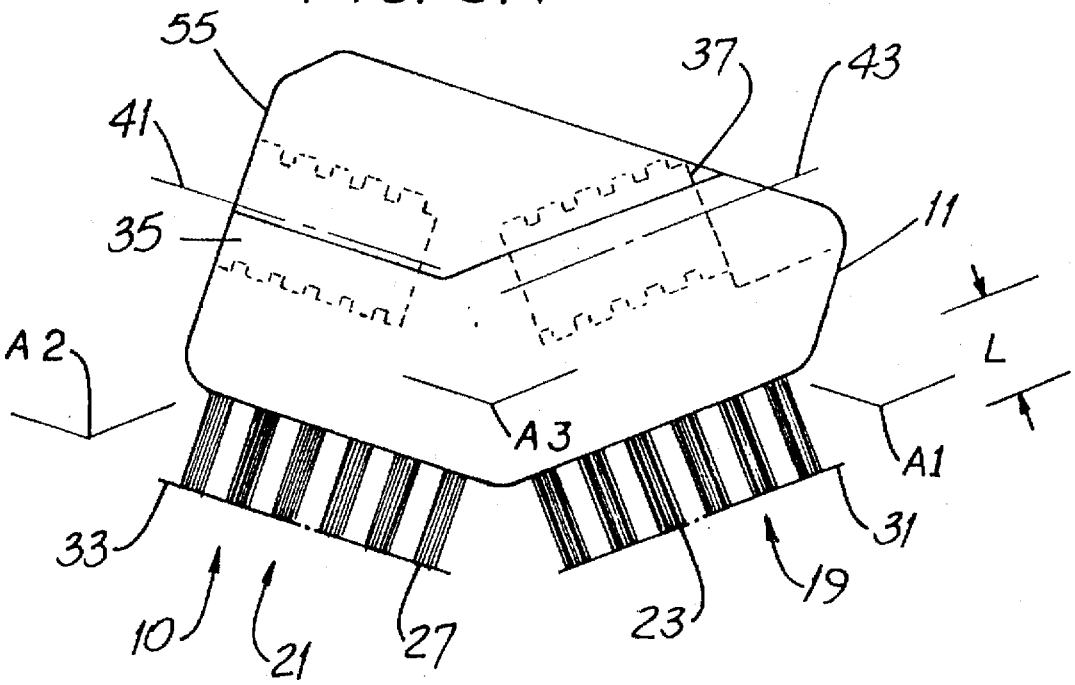
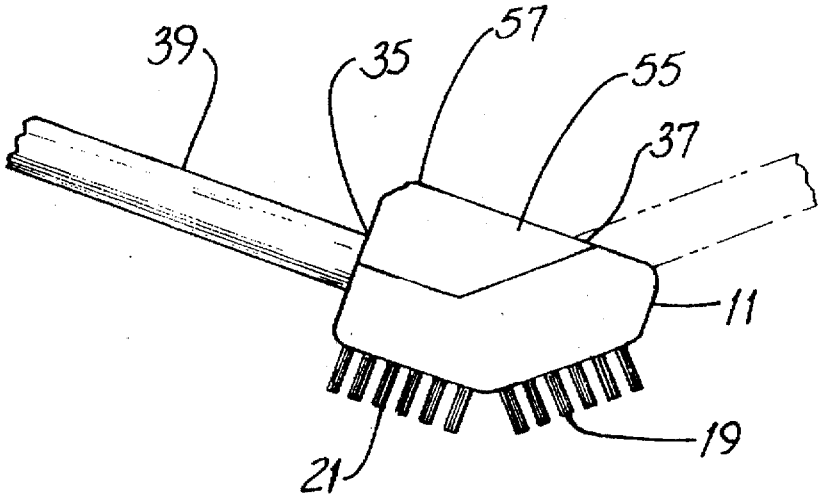
FIG. 3B

METHOD FOR REMOVING SPOTS FROM CARPET

RELATED APPLICATION

This application is a division of application Ser. No. 08/338,948 filed on Nov. 14, 1994, now U.S. Pat. No. 5,537,707.

FIELD OF THE INVENTION

The invention relates generally to brushing and cleaning and, more particularly, to carpet brushing for spot removal.

BACKGROUND OF THE INVENTION

The three primary approaches used to clean commercial and residential carpet involve steam or hot water, foam and "particulate" systems. The latter two are often referred to as "dry" systems since (unlike carpet cleaned with steam or hot water) the cleaned carpet is ready for use immediately after cleaning with such systems. Particulate systems are further divided into categories involving a dry (or substantially dry) powder and involving granules, most of which are substantially larger than a powder grain. The granules are moistened with cleaning solvents for dirt removal. The leading particulate system, the HOST® dry extraction system, was developed by Racine Industries, Inc. of Racine, Wis., and involves use of its HOST® extractor SPONGES® carpet cleaner.

Aspects of the HOST® system involve application of HOST® extractor SPONGES® carpet cleaner to carpet fibers using a machine like that shown in U.S. Pat. No. 2,842,788 (Rench et al.) and U.S. Pat. No 2,961,673 (Rench et al.). Cleaning relatively large areas of carpet in this way is efficient. The "setup" time is relatively short compared to the time actually spent in cleaning , and the areas are sufficiently large to permit easy machine manipulation. And most important, klare soiled areas of the carpet are thoroughly cleaned.

However, it is common to find carpet which has only one or a few small spots caused by, e.g., a dirty shoe or a food or beverage spill but which is otherwise relatively clean. And there are carpet installations where it is either not possible to clean the carpet using machine techniques or is not practical because the setup time is disproportionate to the amount of time needed to remove the spot.

Examples of the former include carpets in mobile homes, boats and recreational vehicles, to name but a few. An example of the latter is carpet in an elevator; a spot can be easily removed using a machine but such removal can take an inordinate amount of time unless performed along with large-area cleaning. Large-area cleaning as in an office building or the like is usually performed on an other-than-daily basis, i.e., weekly. But spots can and do appear daily, perhaps even hourly in an area like a cafeteria.

In recognition of frequent, localized carpet spotting, Racine Industries, Inc. has offered a HOST® spotting kit for some time. Such kit includes a hand-held brush with a curved face used to apply HOST® extractor SPONGES® carpet cleaner for localized small-area spot removal. Such brush has bristles of but a single stiffness and because it is used in the "hands-and-knees" position, some are reluctant to use it.

Ordinary, tightly-tufted brushes are not the solution. Granular carpet cleaning product "packs" or "bridges" between the tufts and when that occurs, the bristles cannot bend and move properly and the cleaning ability of the brush is seriously impaired.

Clearly, there is a widespread need for a new product and method for quick, easy removal of carpet spots using low-cost, easy-to-store components which can be used while standing erect and are configured in recognition of the differing characteristics of carpet fibers and piles. As will become apparent, the invention responds to that need in a unique way.

OBJECTS OF THE INVENTION

It is an object of the invention to provide a brush and method overcoming some of the problems and shortcomings of the prior art.

Another object of the invention is to provide a brush particularly configured for removing spots from carpet.

Another object of the invention is to provide a brush which can be used while standing erect or substantially so.

Another object of the invention is to provide a brush for carpet de-spotting using a granular carpet cleaning product.

Still another object of the invention is to provide a brush which resists "packing" or "bridging" when used with a granular carpet cleaning product.

Another object of the invention is to provide a brush having differing types of brush portions for removing spots from differing types of carpets.

Another object of the invention is to provide a brush useful for feathering or blending a cleaned area with an untreated area to substantially remove any visual demarcation between such areas.

Yet another object of the invention is to provide a brush having a sufficiently "open" configuration that line-like traces of the granular cleaning product are permitted to reside on the spot being removed.

Still another object of the invention is to provide a quick and easy method for removing a spot in a carpet.

Another object of the invention is to provide a method for quickly removing a spot in a carpet using a granular cleaning product and low-cost equipment. How these and other objects are accomplished will become more apparent from the following descriptions taken in conjunction with the drawing.

SUMMARY OF THE INVENTION

In a highly preferred embodiment, the invention involves a brush of the type having first and second faces and first and second brush portions on the first and second faces, respectively. In the improvement, particularly suited for "de-spotting" carpet, the first brush portion includes tuft bristles of a first size and the second brush portion includes tuft bristles of a second size different from the first size. The brush portions thereby have differing degrees of stiffness or "aggressiveness" and are suited for removing spots from carpet of differing types.

In a more specific embodiment, the tuft bristles of the first brush portion have a diameter dimension in the range of 0.010 inch to 0.014 inch and, most preferably, the diameter is about 0.012 inch. Further, tuft bristles of the brush portions protrude from their respective faces by a length of between 0.375 inch and 0.625 inch and, most preferably, by about 0.5 inch. Nylon of the 6.12 type makes an excellent bristle material.

The foregoing bristle diameters, protrusion dimensions and material provide a bristle which has the right amount of stiffness to "stroke" or brush granules of HOST® extractor SPONGES® carpet cleaner along carpet fibers for good cleaning. On the other hand, such bristles have a tendency to bend during brushing to a degree that significant fraying, abrading or "blooming" of the fiber ends is avoided.

In another aspect of the invention, the first and second brush portions are on a body having first and second opposed holes therein to accept a detachable a handle at either hole, depending upon the brush portion to be used. The holes extend along first and second axes, respectively. The first axis defines a first obtuse angle with the first brush portion, the second axis defines a second obtuse angle with the second brush portion and the obtuse angles are substantially equal to one another. And in a specific embodiment, the body includes first and second body portions defining a third obtuse angle therebetween and the first, second and third obtuse angles are substantially equal to one another.

Because the first and second brush portions have differing degrees of stiffness, it is preferable to be able to identify a particular portion other than by tactile sensing. To that end, the first and second brush portions include differing visual indicia of stiffness and preferably, such portions differ in color, e.g., black and white.

From experience and without looking at the brush portions, the brush user may know which portion s/he wishes to use on a particular carpet. Therefore, it is also preferred that the brush include a marker visible from the top of the brush and identifying each one of the holes to a particular one of the brush portions. In that way, the user can thread the brush handle into the proper hole and be assured that when the handle is at an angle (as it would be when a standing person uses the brush), the selected brush portion is directly downward and about parallel to the carpet for spot-removing brushing.

In another aspect of the invention, the new brush is configured for rapid, highly-effective spot removal using a granular cleaning product, e.g., HOST® extractor SPONGES® carpet cleaner. The brush has a body extending along a body axis and has a first face with a first brush portion on such face. The first brush portion is defined by first and second rows of bristle tufts disposed along first and second row axes, respectively. Such row axes are generally normal to the body axis and bristle tufts of the first row are spaced laterally and longitudinally from tufts of the second row.

When so configured, the brush works very well with a granular cleaning product while yet avoiding brush "packing" with the product. By way of contrast, if the cleaning product is used with a brush having closely-spaced tufts, the product packs and substantially fills the between-tuft spaces and prevents optimum bristle cleaning action. The bristles simply cannot move properly as the carpet is being brushed.

The brush tufts and row "pattern" described in more detail below have been selected to be compatible with a granular cleaning product comprised of granules of differing size. Preferably, about 65–75% of the granules are in the range of 300 to 450 microns in size.

And that is not all. The new brush has rows of bristle tufts arranged so that adjacent rows define an elongate trough-like space between them. In a brush configured for use with the HOST® extractor SPONGES® carpet cleaner, the space has a width (measured between row axes such as axes 71 and 73) in the range of about 0.187 inch to about 0.437 inch with 0.32 inch being highly preferred.

The space runs generally normal to the body axis and as the brush is urged over the spot, the cleaning product is permitted to reside in essentially-parallel "traces" across the spot and in registry with the space. (As used herein, the term "trace" means a mark or line left by something that has passed.) To put it another way, the new brush does not remove all of the cleaning product from the spot as such brush passes over the spot. Rather, parallel lines of cleaning product are left behind for re-use in removing the spot.

Other aspects of the invention involve a method for using the new brush to remove a spot from a carpet. Such method includes identifying the type of carpet, e.g., short-tuft commercial loop-pile carpet, and selecting one of the brush portions for use in removing the spot. The handle is attached to the hole related to the selected portion and a granular cleaning product is deposited on the spot. (It is apparent that the method can be practiced in steps ordered other than as set forth above. For example, the cleaning product can be deposited on the spot at any time.) The selected brush portion is then urged across the carpet, thereby forming traces of the cleaning product on the spot.

In a brush embodiment having two brush portions (as is preferred) and where the first brush portion is stiffer than the second brush portion, the selecting step includes selecting the first brush portion and the attaching step includes attaching the handle to the hole related to such first brush portion. The first brush portion is repetitively urged across the carpet to substantially remove the spot, thereby creating a cleaned area contiguous with an untreated area.

As the selected brush portion is urged across the carpet, plural traces of the cleaning product are formed on the spot. Each trace is substantially in registry with a space between two adjacent rows. Good spot-removal practice dictates that the cleaning product be brushed across the spot in several different directions. Therefore, the method preferably includes the step of urging the selected brush portion angularly across the traces.

After the spot is removed, it is not uncommon for the cleaned area to appear to have a very slightly lighter "tone" than the adjacent untreated area. The new brush permits "feathering" the cleaned and the untreated areas so that such cleaned area is no longer visually apparent or at least not significantly so. To that end, the method includes the steps of re-attaching the handle to the hole related to the second brush portion and urging the second brush portion across the cleaned area and the untreated area, thereby substantially removing any visual demarcation between the areas.

Further details regarding the invention are set forth in the following detailed description and in the drawing.

BRIEF DESCRIPTION OF THE DRAWING

FIG. 3A is an end elevation view of the brush taken generally along the viewing axis VA3 of FIG. 2. Surfaces of parts are shown in dashed outline.

FIG. 3B is another end elevation view of the brush taken generally along the viewing axis VA3 of FIG. 2 and showing how the brush handle may be attached at either of two holes. One handle position is shown in dashed outline and parts are broken away.

DETAILED DESCRIPTION OF PREFERRED EMBODIMENTS

Figure 1:
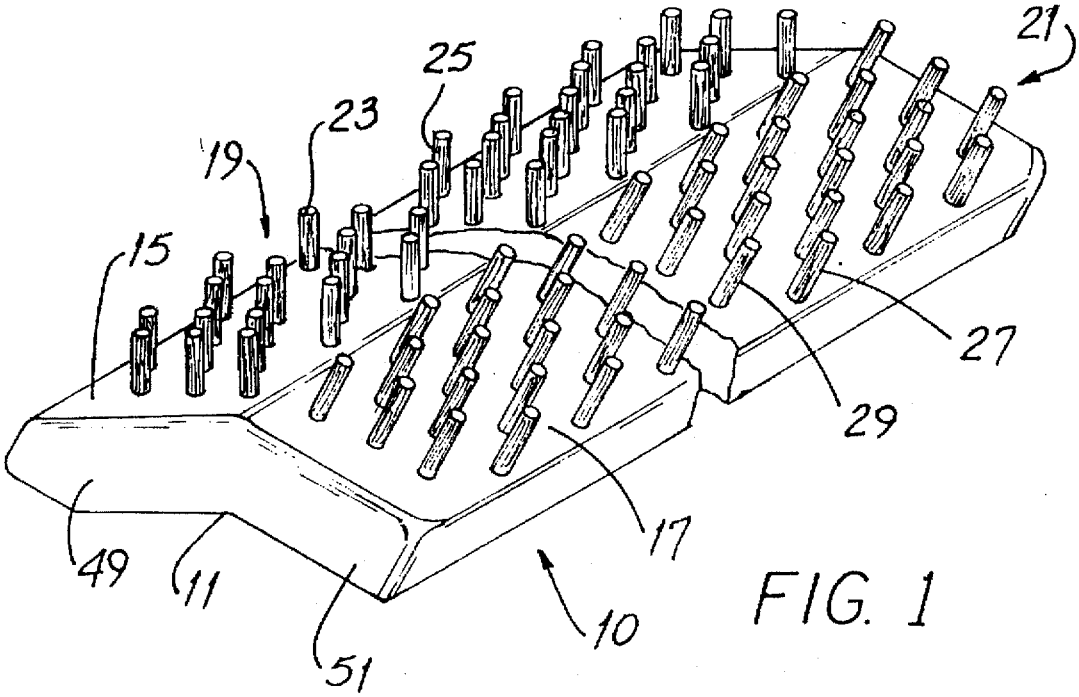
FIG. 1 is a perspective view of the underside of the new brush. Parts are broken away.

Referring first to FIGS. 1, 2, 3A and 3B, the new brush 10 has a rigid body 11 preferably molded of plastic. Such body 11 extends along a body axis 13 and has first and second generally planar faces 15 and 17, respectively, and first and second brush portions 19, 21, respectively, on the first and second faces 15, 17, respectively. The first brush portion 19 includes tufts 23 made of bristles 25 of a first, larger size with a diameter dimension in the range of 0.010 inch to 0.014 inch. Most preferably, the diameter is about 0.012 inch.

The second brush portion 21 includes tufts 27 made of bristles 29 of a second size different from the first size and preferably smaller than the first size.

Further, tuft bristles 25, 29 of the brush portions 19 and 21, respectively, protrude from their respective faces 15 and 17 by a length L of between 0.375 inch and 0.625 inch. Most preferably, the protrusion dimension L is about 0.5 inch. Nylon of the 6.12 type makes an excellent bristle material. The foregoing bristle diameters, protrusion dimensions and material provide bristles 25, 29 which have the proper amount of stiffness to "stroke" or brush granules of the granular cleaning product HOST® extractor SPONGES® carpet cleaner along carpet fibers for good cleaning.

In FIG. 3A, it will be noted that the ends of the tufts 23 of the first portion 19 are substantially coincident with a plane 31 while the ends of the tufts 27 of the second portion are substantially coincident with the plane 33. The resulting "flatness" of the portions 19, 21 is preferred even though the faces 15, 17 in which the tufts 23, 27 are mounted may have some curvature.

As shown in FIGS. 1, 2, 3A and 3B the body 11 of the new brush 10 has first and second opposed holes 35, 37 therein to accept a detachable handle 39 at one hole or the other, depending upon the brush portion 19 or 21 to be used. The holes 35, 37 extend along first and second axes 41 and 43, respectively. The first axis 41 defines a first obtuse angle A1 with the first brush portion 19, the second axis 43 defines a second obtuse angle A2 with the second brush portion 21 and the obtuse angles A1, A2 are substantially equal to one another. And in a specific embodiment, the body 11 includes first and second body portions 49, 51 defining a third obtuse angle A3 therebetween and the first, second and third obtuse angles A1, A2, A3 are substantially equal to one another.

The first and second brush portions 19, 21 have differing degrees of stiffness which, of course, can be identified by tactile sensing. But the brush 10 is easier to use if one is able to identify a particular portion other than by tactile sensing. To that end, the first and second brush portions 19, 21 include differing visual indicia of stiffness and preferably, such portions differ in color, e.g., black and white, respectively. In FIG. 3A, the tufts 23 of the first portion 19 are darkened as compared to the tufts 27 of the second portion 21 to represent the difference in color.

From experience and without looking at the brush portions 19, 21 the brush user may know which portion 19 or 21 s/he wishes to use on a particular carpet. To that end (as well as for other reasons relating to handle attachment), the brush 10 includes an upwardly-protruding boss 55 having a flat top surface 57.

Figure 4:
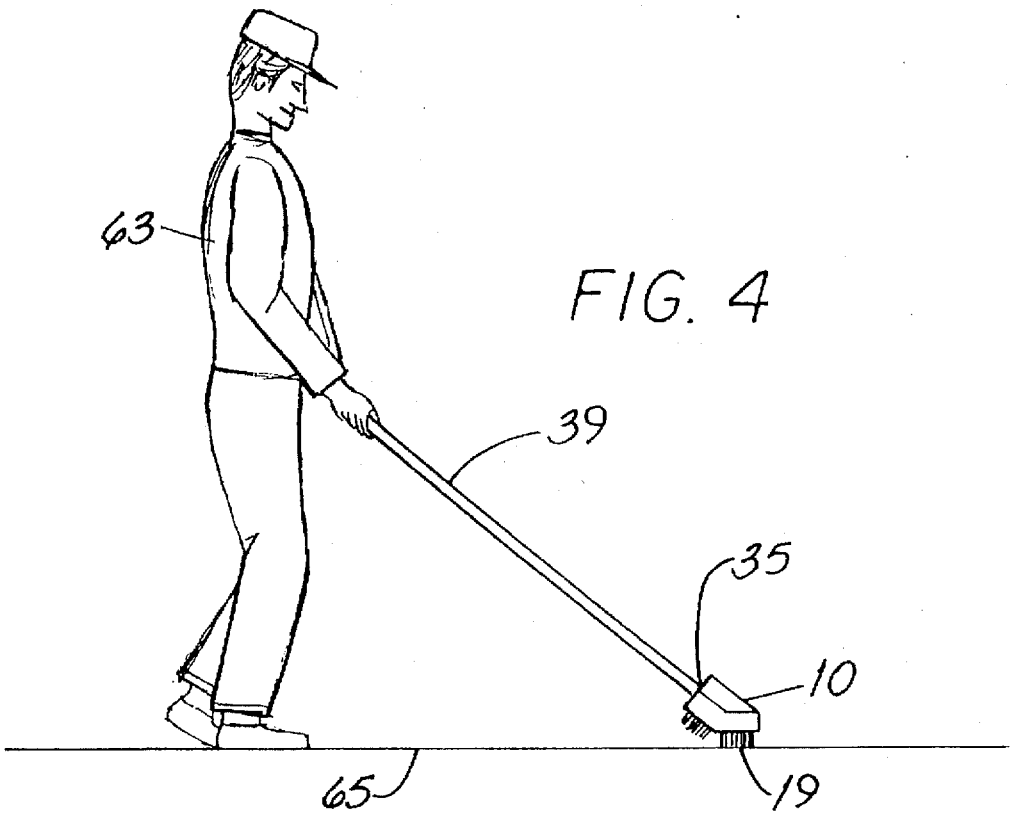
FIG. 4 is a side elevation view showing how the new brush is used to remove a spot from a carpet.
Figure 2:
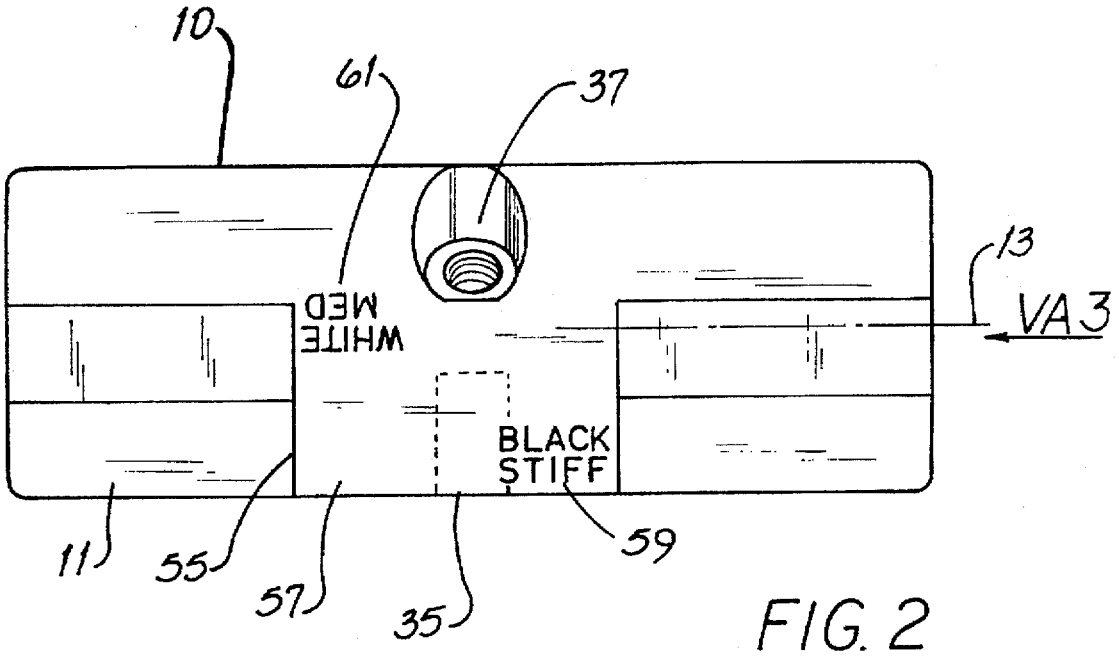
FIG. 2 is a top plan view of the new brush.

Such surface 57 includes two markers 59, 61 which are visible from the top of the brush 10 and which identify each one of the holes 35, 37 to a particular one of the brush portions 19, 21, respectively. In that way, the user can thread the brush handle 39 into the proper hole 35 or 37 and be assured that when the handle 39 is at an angle as shown in FIG. 4 (as it would be when a standing person 63 uses the brush 10), the selected brush portion 19 or 21 is directly downward and about parallel to the carpet 65 for spot-removing brushing. To state it otherwise by way of example, when the handle 39 is threaded to the first hole 35, the first brush portion 19 will be directly downward when the brush 10 is in use.

Figure 5:
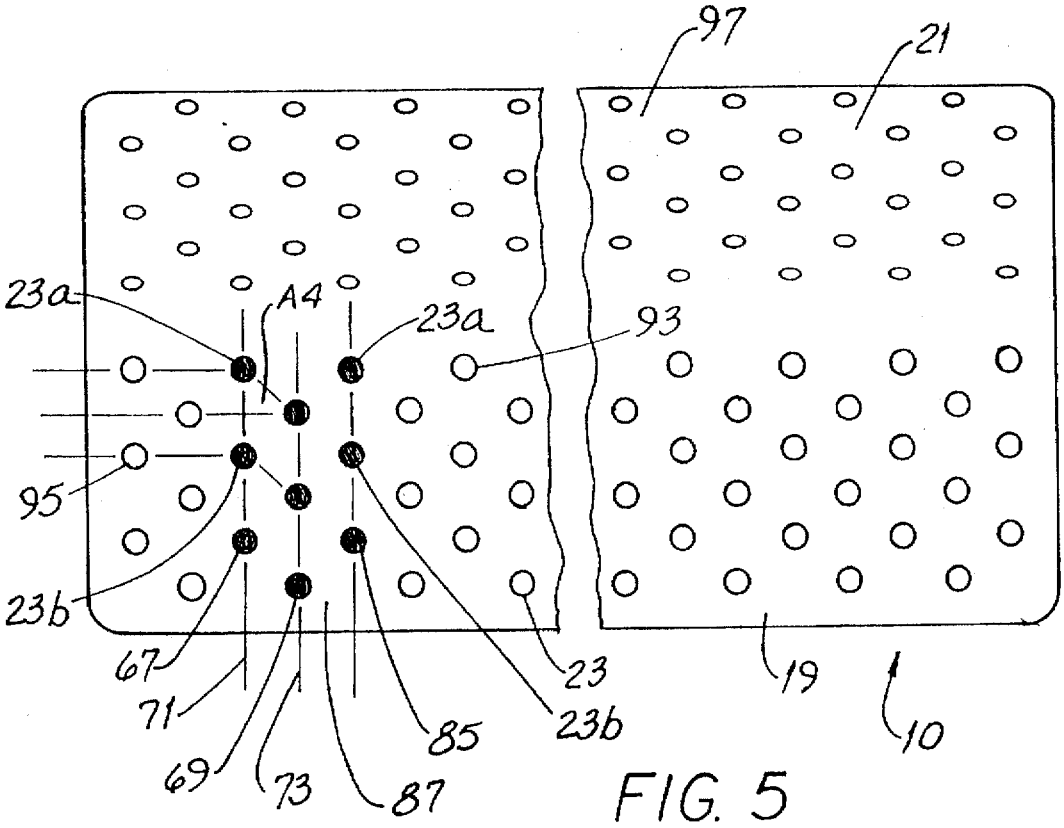
FIG. 5 is a bottom view of the brush body showing features of the hole pattern used with the first and second brush portions. Certain holes are blackened to represent tufts of bristles.
Figure 6:
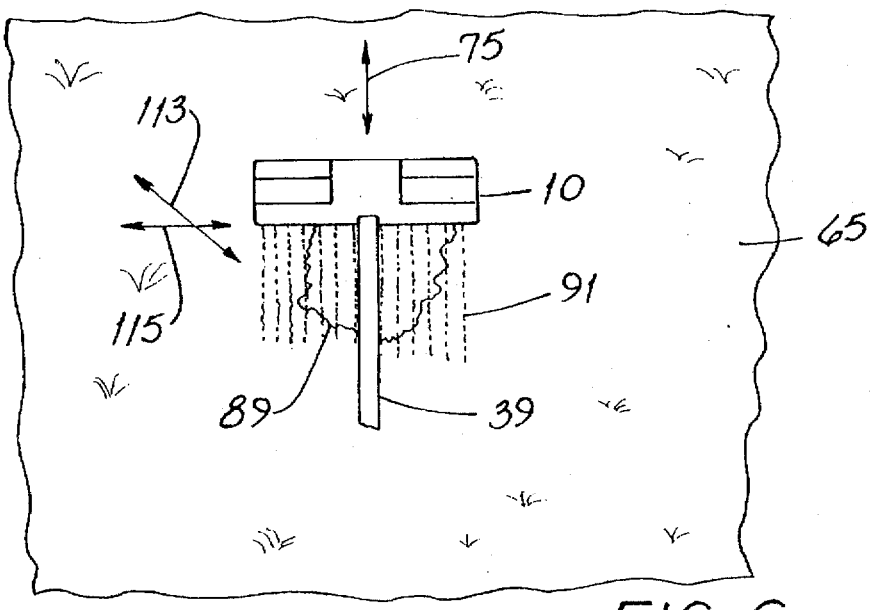
FIG. 6 is a top plan view of the brush as it is being used to remove a spot from a carpet.

Referring also to FIGS. 5 and 6, in another aspect of the invention, the new brush 10 is configured for rapid, highly-effective spot removal using a granular cleaning product, e.g., HOST® extractor SPONGES® carpet cleaner. Each brush portion 19, 21, e.g., the first brush portion 19, is defined by first and second rows 67, 69 of bristle tufts 23 disposed along first and second row axes 71, 73, respectively.

Such row axes 71, 73 are generally normal to the body axis 13 (when the axes 13, 71, 73 are at or projected to the same plane), are generally parallel to the direction of brush movement during spot removal (as represented by the arrow 75) and bristle tufts 23 of the first row 67 are spaced laterally and longitudinally from tufts 23 of the second row 69. The angle A4 is the result of spacing. In a preferred embodiment, such angle A4 is in the range of 35° to 55° and, most preferably, is about 45°. (As used in this specification, "laterally" means in the direction of the body axis 13 and "longitudinally" means in the direction of normal brush movement during spot removal.)

Figure 7:
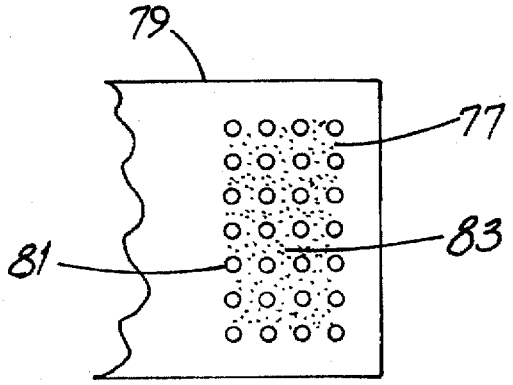
FIG. 7 PRIOR ART
FIG. 7 is a bottom view of a prior art brush showing how the tufts thereof become packed with granular cleaning product.

When so configured, the brush 10 works very well with a granular cleaning product while yet avoiding brush "packing" with the product. Referring also to FIG. 7 and by way of contrast, if the cleaning product 77 is used with a brush 79 having closely-spaced tufts 81, the product 77 packs and substantially fills the between-tuft spaces 83 and prevents optimum bristle cleaning action. The bristles simply cannot move properly as the carpet 65 is being brushed.

Referring again to FIGS. 5 and 6, the new brush 10 has rows 67, 69 of bristle tufts 23 arranged so that adjacent rows (such as rows 67, 69 or rows 69, 85) define an elongate trough-like space 87 between them. In a brush 10 configured for use with the HOST® extractor SPONGES® carpet cleaner, the space 87 has a width (measured at the "roots" of the tufts 23 and between row axes such as axes 67 and 69) in the range of about 0.187 inch to about 0.437 inch with 0.32 inch being highly preferred.

The space 87 runs generally normal to the body axis 13 and as the brush 10 is urged over the spot 89, the cleaning product 77 is permitted to reside in essentially-parallel "traces" 91 across the spot 89 and in registry with the space 87. (As used herein, the term "trace" means a mark or line left by something that has passed.) To put it another way, the new brush 10 does not remove all of the cleaning product 77 from the spot 89 as such brush 10 passes over the spot 89. Rather, parallel lines of cleaning product 77 are left behind for re-use in removing the spot 89.

Similarly, brush tufts like tufts 23*a* forming line 93 and 23*b* forming line 95 are arranged in lines 93, 95 parallel to the body axis 13. The spacing between the tufts of a particular line, such as between tufts 23*a* of line 93, is preferably in the range of 0.50 inch to 0.75 inch and, most preferably, is about 0.62 inch. And the spacing between adjacent lines such as lines 93 and 95 is preferably in the range of 0.18 inch to 0.32 inch and, most preferably, is about 0.27 inch. (It is to be appreciated that in a highly preferred embodiment of the brush 10, the "hole pattern" 97 of the brush second portion 21 is substantially identical to that described above.)

Figure 8:
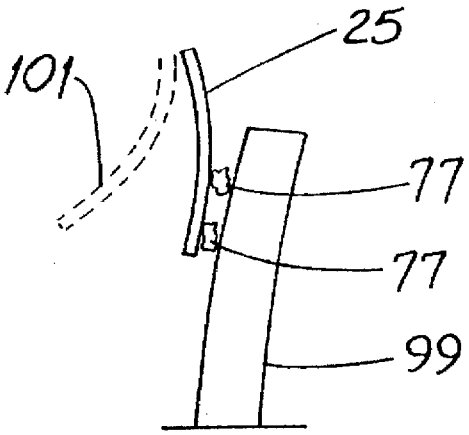
FIG. 8 is a representative side elevation view, greatly enlarged, showing a carpet fiber and relative bristle stiffness, e.g., preferred in solid outline and too soft in dashed outline.
Figure 9:
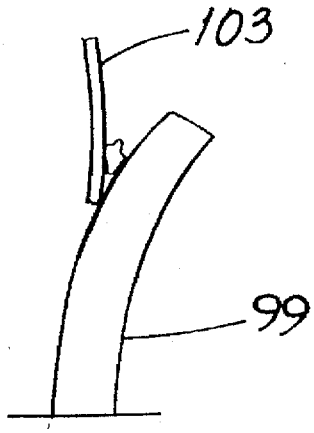
FIG. 9 is a representative side elevation view, greatly enlarged, showing a carpet fiber and relative bristle stiffness, e.g., too stiff.

The new brush 10 is said to have just the right amount of "bite" for commercial carpets. This characteristic is illustrated by FIGS. 8 and 9. In FIG. 8, the preferred bristle (such as bristle 25) shown in solid outline bends sufficiently to retain the granular cleaning product 77 between such bristle 25 and the carpet fiber 99 and "stroke" such product 77 along the fiber 99. Such bristle 25 is thereby said to exhibit the right amount of bite.

Figure 10:
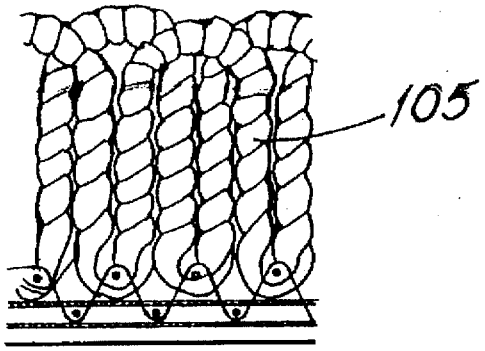
FIG. 10 is a representative side elevation view showing the construction of a short-tuft commercial loop-pile carpet.
Figure 11:
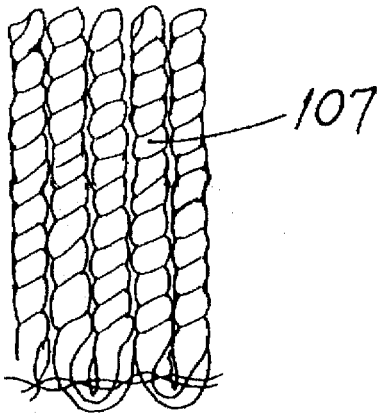
FIG. 11 is a representative side elevation view showing the construction of a longer-tuft cut-pile carpet.

The bristle 101 represented by the dashed outline in FIG. 8 is too soft and bends away from the carpet fiber 99 upon engaging such fiber 99. Less effective fiber cleaning results. On the other hand, the bristle 103 of FIG. 9 is too rigid and tears at the fiber 99 with resulting fiber fraying or "blooming." Other aspects of the invention involve a method for using the new brush 10 to remove a spot 89 from a carpet 65. Such method includes identifying the type of carpet 65, e.g., short-tuft commercial loop-pile carpet 105 such as shown in FIG. 10 or a longer-tuft cut-pile carpet 107 such as shown in FIG. 11. One of the brush portions 19, 21 is then selected for use in removing the spot 89. In the case of a short-tuft commercial loop-pile carpet 105, the first, stiffer portion 19 may be the appropriate choice while in the case of a longer-tuft cut-pile carpet 107, the second portion 21 with its softer tufts 27 may be appropriate.

The handle 39 is attached to the hole 35 or 37 related to the selected portion 19 or 21 and a granular cleaning product 77 is deposited on the spot 89. The selected brush portion 19 or 21 is then urged across the carpet 65, thereby starting to remove the spot 89 and forming traces 91 of the cleaning product 77 on the spot 89.

In a brush embodiment having two brush portions 19, 21 (as is preferred) and where the first brush portion 19 is stiffer than the second brush portion 21, the selecting step includes selecting the first brush portion 19 and the attaching step includes attaching the handle 39 to the hole 35 related to such first brush portion 19. The first brush portion 19 is repetitively urged across the carpet 65 to substantially remove the spot 89, thereby creating a cleaned area 109 contiguous with an untreated area 111.

As the selected brush portion 19 or 21 is urged across the carpet 65, plural traces 91 of the cleaning product 77 are formed on the spot 89. Each trace 91 is substantially in registry with a space 87 between two adjacent rows 67, 69. Good spot-removal practice dictates that the cleaning product 77 be brushed across the spot 89 in several different directions. Therefore, the method preferably includes the step of urging the selected brush portion 19 or 21 angularly across the traces 91 as represented by the arrows 113, 115.

Figure 12:
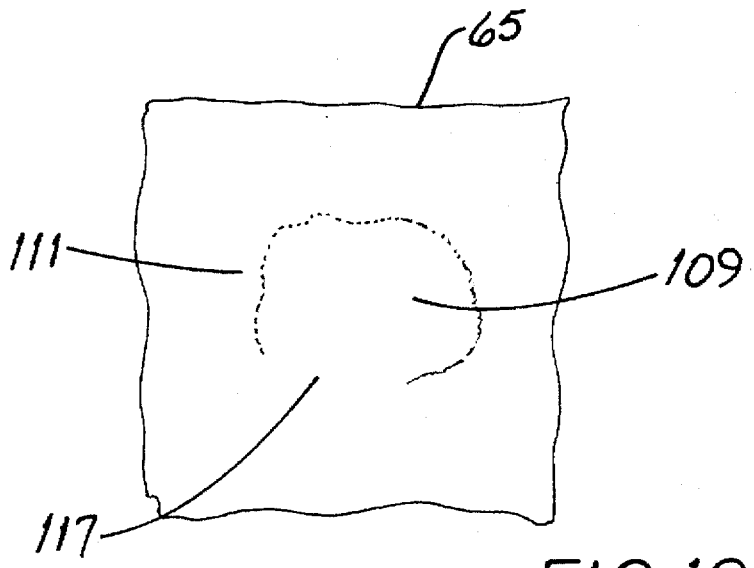
FIG. 12 shows an area of carpet from which a spot has been removed. Parts of the carpet are broken away.

After the spot 89 is removed, it is not uncommon for the cleaned area 109 to appear to have a very slightly lighter "tone" than the adjacent untreated area 111 and this fact is represented by the light dashed outline in FIG. 12. The new brush 10 permits "feathering" the cleaned and the untreated areas 109, 111 so that such cleaned area 109 is no longer visually apparent or at least not significantly so. To that end, the method includes the steps of re-attaching the handle 39 to the hole 37 related to the second brush portion 21 and urging the second brush portion 21 across the cleaned area 109 and the untreated area 111, thereby substantially removing any visual demarcation between the areas. The removal of such visual demarcation between the areas 109, 111 is represented by the absence of the dashed outline of the location 117.

Figure 13:
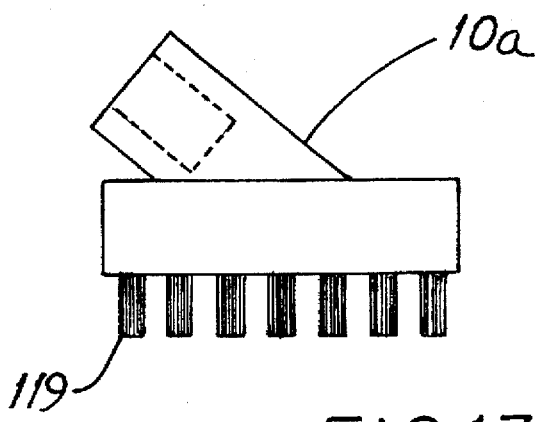
FIG. 13 is an end elevation view of another embodiment of the new brush.

While the principles of this invention have been shown and described in connection with a few preferred embodiments, it is to be understood clearly that such embodiments are exemplary and are not limiting. For instance, the new brush 10 may be configured as shown in FIG. 13 with but a single brush portion 119 configured like portion 19 or 21. While such configuration is less convenient to use (one has to purchase and keep track of separate brushes), it would be equally effective.

What is claimed is:

1. A method for substantially removing a spot from a carpet by using a brush having (a) a detachable handle, (b) a body extending along a body axis and having a pair of holes in the body for attaching the handle to the body at either hole, (c) first and second brush portions on first and second brush faces, respectively, and wherein the portions having differing stiffness and each portion is related to a different hole, and wherein each portion has tufts of bristles arranged in rows extending generally perpendicularly to the body axis and each pair of adjacent rows has an elongate space therebetween, the method including the steps of:

identifying the tuft and pile characteristics of carpet;

selecting one of the brush portions for use in removing the spot;

attaching the handle to the hole related to the selected portion;

depositing a granular cleaning product on the spot for spot removal; and urging the selected brush portion across the carpet and the cleaning product, thereby intentionally leaving row traces of the cleaning product at locations in registry with the spaces.

2. The method of claim 1 wherein:

the first brush portion is stiffer than the second brush portion;

the selecting step includes selecting the first brush portion;

the attaching step includes attaching the handle to the hole related to the first brush portion;

and the method further includes the steps of:

repetitively urging the first brush portion across the carpet and the traces to substantially remove the spot, thereby creating a cleaned area contiguous with an untreated area;

re-attaching the handle to the hole related to the second brush portion; and urging the second brush portion across the cleaned area and the untreated area, thereby substantially removing any visual demarcation between the areas.

3. The method of claim 1 further including a second urging step comprising urging the selected brush portion angularly across the traces.

* * * * *

UNITED STATES PATENT AND TRADEMARK OFFICE

CERTIFICATE OF CORRECTION

PATENT NO. : 5,707,454

DATED : January 13, 1998

INVENTOR(S) : Ernest W. Middleton

It is certified that error appears in the above-indentified patent and that said Letters Patent is hereby corrected as shown below:

In Column 1, line 35, delete the "," after "cleaning".

In Column 1, line 37, delete "klare" and insert --large-- in its place.

Signed and Sealed this

Twenty-first Day of April, 1998

Bruce Lehman

*Attest:*

BRUCE LEHMAN

*Attesting Officer*

*Commissioner of Patents and Trademarks*